US005582327A

United States Patent [19]

de Laforcade

[11] Patent Number: 5,582,327

[45] Date of Patent: Dec. 10, 1996

[54] DEVICE FOR PREPARING, MEASURING, AND DISPENSING A COSMETIC PRODUCT

[75] Inventor: Vincent de Laforcade, Clamart, France

[73] Assignee: L'Oreal, Paris, France

[21] Appl. No.: 361,650

[22] Filed: Dec. 22, 1994

[30] Foreign Application Priority Data

Dec. 22, 1993 [FR] France ..... 93 15442

[51] Int. Cl.[6] ..... G01F 11/00

[52] U.S. Cl. ..... 222/1; 222/157; 222/212; 222/490; 222/494; 222/568

[58] Field of Search ..... 222/1, 154, 156, 222/157, 206, 215, 490, 494, 568, 212; 141/2, 3, 18, 20, 67

[56] References Cited

U.S. PATENT DOCUMENTS

| | | | |
|---|---|---|---|
| 2,500,639 | 3/1950 | Lermer | 222/156 X |
| 3,523,630 | 8/1970 | Catapano | 222/568 |
| 3,809,289 | 5/1974 | Komendowski | 222/83 |
| 4,294,293 | 10/1981 | Lorenz et al. | 141/100 |
| 4,427,039 | 1/1984 | Brooks et al. | 141/20 |
| 4,602,651 | 7/1986 | Roppatte | 132/88.5 |
| 4,872,594 | 10/1989 | Bloom | 222/568 X |
| 5,209,565 | 5/1993 | Goncalves | 366/130 |
| 5,234,138 | 8/1993 | DeLaforcade | 222/490 |
| 5,277,303 | 1/1994 | Goyet et al. | 206/221 |
| 5,411,183 | 5/1995 | Hildebrandt | 141/18 X |
| 5,431,290 | 7/1995 | Vinciguerra | 222/490 X |

FOREIGN PATENT DOCUMENTS

| | | |
|---|---|---|
| 0138681 | 4/1985 | European Pat. Off. . |
| 0217582 | 4/1987 | European Pat. Off. . |
| 0528707 | 2/1993 | European Pat. Off. . |
| 799470 | 6/1936 | France . |
| 855869 | 5/1940 | France . |
| 2429038 | 1/1980 | France . |
| 2666308 | 3/1992 | France . |
| 8805628 | 11/1988 | Germany . |
| 2076649 | 12/1981 | United Kingdom . |
| 2137181 | 10/1984 | United Kingdom . |

*Primary Examiner*—Joseph Kaufman
*Attorney, Agent, or Firm*—Oliff & Berridge

[57] ABSTRACT

The invention relates to a device for preparing, measuring, and dispensing, a cosmetic product, particularly a product for dyeing or bleaching hair, obtained by mixing two liquid, cream, or gel components immediately prior to use. The device comprises a transparent cylindrical body with a flexible wall, provided at both its ends with identical external threads, and two removable end caps provided with identical internal threads. Each cap is able to cooperate with any of the external threads of the body. The wall of the body is provided with at least one series of graduations along the body. One of the caps has a dispensing device and the other cap has an orifice fitted with an automatically closing non-metallic valve.

8 Claims, 2 Drawing Sheets

DEVICE FOR PREPARING, MEASURING, AND DISPENSING A COSMETIC PRODUCT

BACKGROUND OF THE INVENTION

The present invention relates to a device for preparing, measuring, and dispensing a cosmetic product, particularly a product for dyeing or bleaching hair, obtained by mixing two liquid, cream, or gel components immediately prior to use.

In the following, reference will be made essentially to products for dyeing but it is understood that the explanations provided apply equally to products for bleaching.

Proper utilization of dyeing products, usually formed by mixing two components, the oxidizer and the dye, depends largely on the quality of mixing of the two components immediately before application to the hair.

Now, these two components are of very different natures and structures.

The oxidizer, which is generally in liquid or cream form, poses no particular storage problem and is often packed in multidoses in plastic, particularly polyethylene, bottles.

The dye, which is generally liquid, cream, or gel, is very sensitive to oxidation by ambient air, is affected by ultraviolet radiation, and is particularly reactive to metals and metal salts.

The dye is thus usually packaged in hermetic containers, protected from light and air, particularly in the form of a single-use tube, usually made of aluminum, coated on the inside with a varnish or a multilayer protective film.

To decrease costs, the use of multidose cans, particularly of the aerosol type provided with a valve dispensing mechanism, has also been proposed.

When the dye is highly liquid, the dye and oxidizer may be mixed in a container with a transparent wall provided with graduations into which first the oxidizer then the dye is poured, each up to a predetermined graduation mark, to obtain a measured mix.

Special problems arise, however, if the dye is in the form of a cream or gel. If the dye is poured before the oxidizer into the mixing container, mixing is poor and it is not possible to measure simply by reading the level.

If the dye is poured into the oxidizer, the dye, which is less dense, floats on the oxidizer like an iceberg and substantial measuring errors, on the order of 10%, occur and have injurious consequences for the hair-dyeing result.

Hence, the proposal was made in FR-A-2,429,038 of using a transparent container for mixing the components, provided with graduations on its wall, and having an automatically closing valve on its bottom through which the two components, namely the oxidizer and the dye, are introduced in succession, each up to a given graduation mark.

Such a container has, however, the drawback that the permanent presence of a valve in the bottom of the container makes it very difficult to remove any remaining product after utilization.

It is very important to avoid admixing dyes or tints to avoid unpleasant surprises in the result obtained, particularly when a very dark dye is followed by a very light dye on two consecutive heads of hair.

Designing the valve is also complex because it is essential for it to be able to operate only in the direction in which the components enter the mixing container from the outside to the inside, so that the valve must be designed to close positively and not merely passively, without including any metal components or having only metal components that are provided with a coating, particularly a protective varnish.

SUMMARY OF THE INVENTION

A goal of the present invention is to create a device that allows measured preparation and dispensing of a cosmetic product, particularly a product for dyeing or bleaching hair, obtained by mixing two liquid, cream, or gel components immediately prior to use, which is of particularly simple and economical design, and avoids the drawbacks listed above.

The device according to the invention is characterized essentially in that it comprises a transparent cylindrical body with a flexible wall, open at both its ends and provided at said ends with identical external threads, and two removable end caps provided with identical internal threads, each formed on a cylindrical skirt of a respective cap, each of said internal threads being able to cooperate with any of the external threads of the body, the wall of said body being provided with at least one series of graduations, and preferably with two series of graduations running in opposite directions along the body, one of the caps having a means for dispensing the cosmetic product prepared in the device, the other cap having an orifice fitted with an automatically closing non-metallic valve through which one of the components of the cosmetic product can be introduced into the body of the device after the other component has first been introduced into said body through the opposite end before said cap fitted with the dispensing means has been replaced on said opposite end.

"Flexible wall" according to the invention is understood to be a wall which, while being relatively rigid, can be deformed by external pressure with a view to expelling the product resulting from the mixing.

If the cosmetic product is a hair-dyeing product, first the oxidizer is introduced into the container through the end that is to be closed by the cap fitted with the dispensing means and, after said cap has been replaced, the dye from a dye container is introduced through the automatically closing valve provided on the other cap.

It will be understood that, because both the caps of the device according to the invention can be removed simply by unscrewing from the cylindrical body, it is particularly easy to remove the components from the device when cleaning, as the cylindrical body can be easily cleaned with a simple tube brush.

Advantageously, the automatically closing valve is of the type having a dome-shaped membrane convex toward the inside of the body of the device when the cap containing said valve is screwed thereonto, said membrane having at least one slit provided in the vicinity of the top of the dome and being delimited by edges which are able to come in contact with each other to produce a sealed closure in the resting state and which are able to move apart to allow passage of a product fed under pressure from the concave outside wall of the dome-shaped membrane.

The dome-shaped membrane is attached to the cap by pressure means ensuring positive closure of the slit. Such a membrane valve is for example described in FR-A-2,666,308 of the applicant company which presents it as a container output valve and not as an input valve as in the present invention.

When a valve of this type is provided, it is advantageous to use a connecting fitting to introduce the component, such as the dye, that is to be introduced through this valve, said fitting having a dome-shaped protuberance designed to be applied in shape-matching fashion against the concave outside surface of the dome-shaped membrane.

The connecting fitting can in particular be connected for example by a film hinge, either to the cap provided with the automatically closing valve or preferably to the container of the component to be introduced through the automatically closing valve.

The connecting fitting is shaped on the inside to receive the dispensing end of the container of the component to be introduced, which end can, in practice, be the hollow operating rod of a dispensing valve of an aerosol can.

Alternatively, the connecting fitting can be permanently mounted on the dispensing end of said container.

BRIEF DESCRIPTION OF THE DRAWINGS

For better understanding of the invention, a nonlimiting embodiment thereof will now be described with reference to the attached drawing wherein.

DETAILED DESCRIPTION OF PREFERRED EMBODIMENTS

Figure 1:
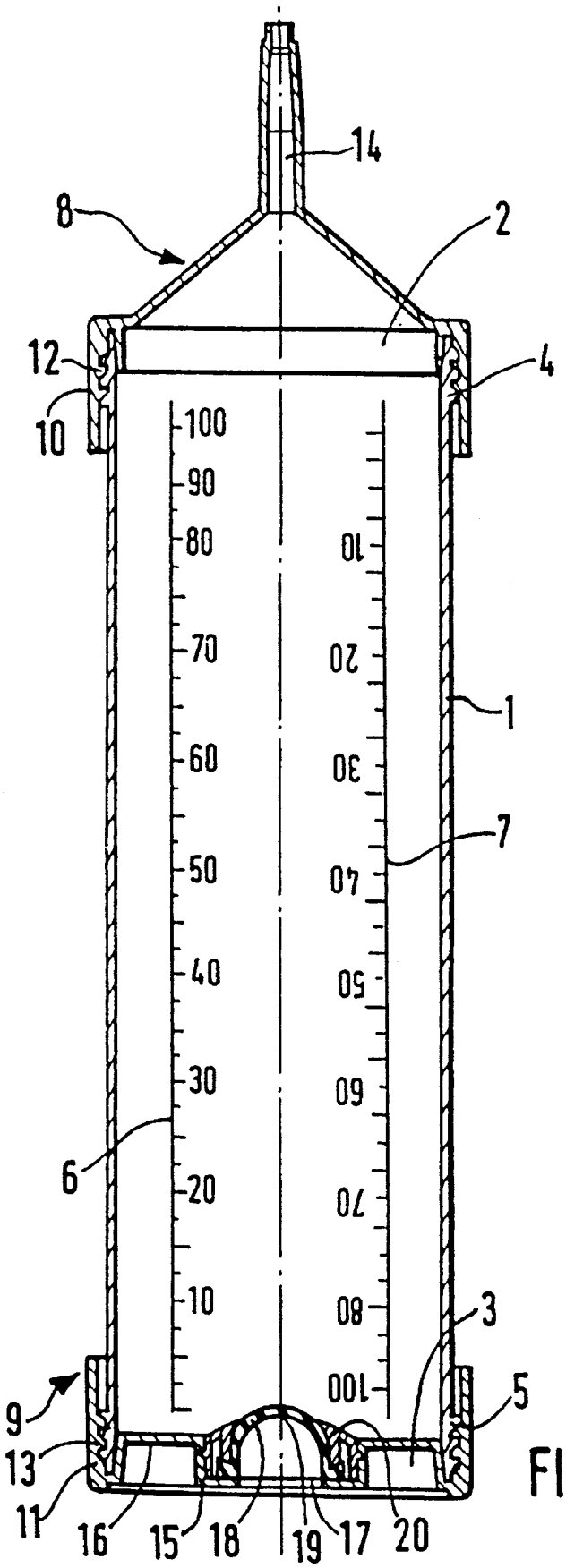
FIG. 1 is a lengthwise section through the device according to the present invention.

The device according to the invention (as shown in FIG. 1) has an elongate cylindrical body 1 made of transparent plastic, for example polyethylene or polypropylene, open at both its ends 2, 3, said body having at said ends, on the exterior of its wall, threads 4 and 5 which are identical to each other.

The body also has two series of symmetrical graduations 6 and 7 running in opposite directions.

According to the invention, the device has two end caps 8 and 9 to close open ends 2, 3 of body 1, selectively.

The two end caps have identical cylindrical skirts 10 and 11 respectively provided with internal threads 12 and 13 able to mesh with threads 4 and 5 provided on the wall of body 1.

Because of this configuration, cap 8 which is illustrated in FIG. 1 mounted on end 2 of cylindrical body 1 can be mounted on end 3 and likewise end cap 9 can be mounted on end 3.

End cap 8 is provided with a dispensing duct 14 on which a sealing tip or stopper (not shown) can be mounted.

Bottom wall 15 of cap 9 has a reinforcing annular cavity 16 and a central orifice 17.

Orifice 17 is closed on its inside by an automatically closing valve composed of a dome-shaped membrane 18 which is convex toward the inside of the body of the device, said membrane having at least one slit 19 in the vicinity of the dome top.

Membrane 18 is attached to cap 9 through an annular part 20 applied to the bottom wall of the cap.

Figure 2:
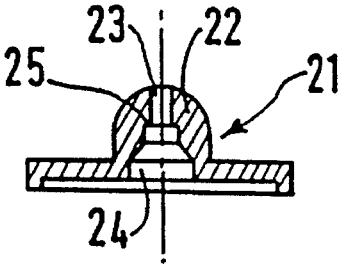
FIG. 2 is a cross section through a connecting fitting usable with the device in FIG. 1.

FIG. 2 illustrates a connecting fitting designed to be mounted on end cap 9 to introduce a mixing component into body 1 through membrane valve 18.

Figure 3:
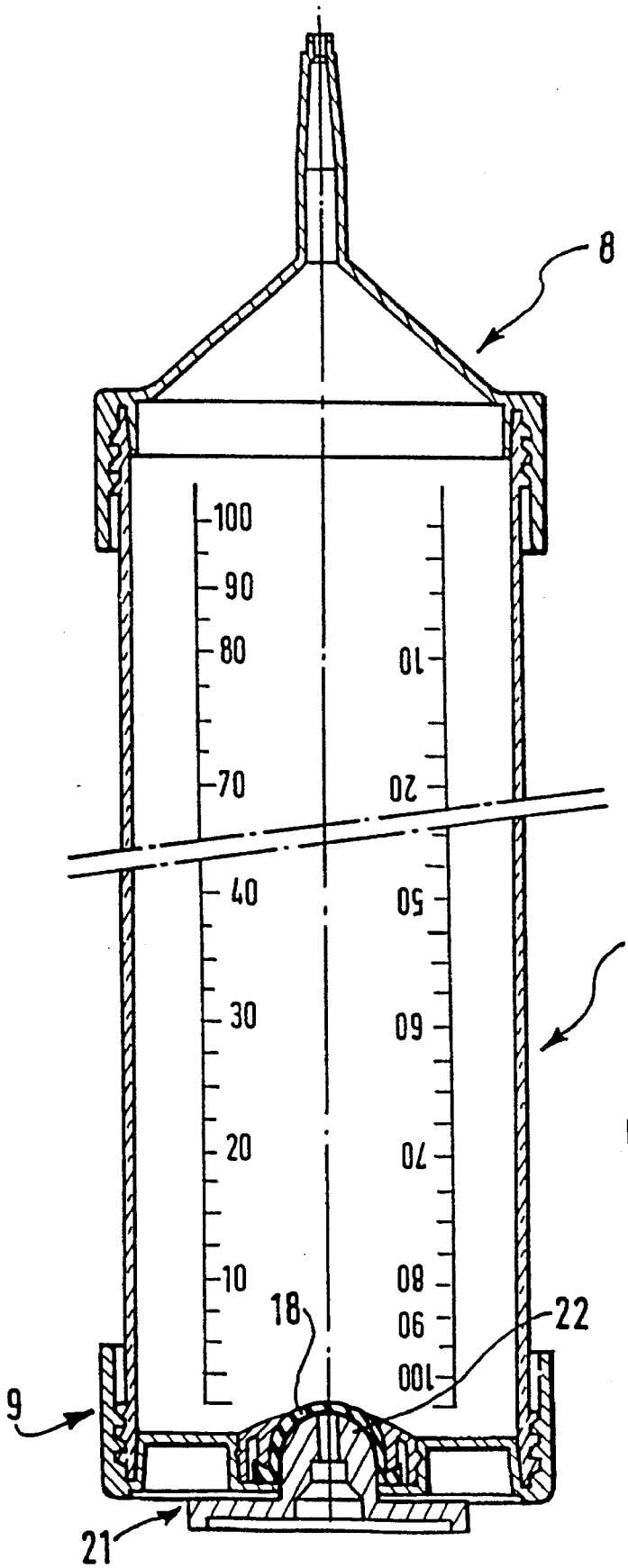
FIG. 3 is a cross section illustrating the connecting fitting of FIG. 2 mounted on the device illustrated in FIG. 1.

The fitting, designated overall by 21, has a dome-shaped protuberance 22 designed, as illustrated in FIG. 3, to engage orifice 17 of end cap 9 and be applied in shape-matching fashion against the concave outer surface of dome-shaped membrane 18.

On the inside, the connecting fitting has a cylindrical duct 23 terminating at the center of dome-shaped protuberance 22. Duct 23 communicates with an internal cavity 24 having at least one bearing surface 25 designed such that, when an operating rod of a valve of a container such as an aerosol can, not shown, is introduced into connecting fitting 21 up to duct 23, surface 25 constitutes a stop allowing relative displacement of said operating rod relative to the body of the container and expulsion of the product contained through slit 19 in membrane 18.

The device according to the invention can be used as follows to prepare a product for dyeing hair.

Starting from the position illustrated in FIG. 1, the user, after unscrewing cap 8, pours, through opening 2, the oxidizer up to the required level indicated by graduation marks 6.

For introducing the dye, the user then brings the container (not shown) up to the device, on which container connecting fitting 21 is mounted by a film hinge. After introducing the connecting fitting into cap 9 as illustrated in FIG. 3, with the dispensing rod of the container of dye being engaged in duct 23 of connecting fitting 21, the user moves the device according to the invention slightly downward to activate the valve of the dye container and release the latter which passes through duct 23 then opens membrane 18 and penetrates body 1 of the device.

Because of the surface contact between the protuberance of the fitting and the membrane, no quantity of dye is deposited on the outside of the device.

The level of oxidizer present in the body of the device rises and as soon as the required level is reached the user releases the pressure exerted downward on the device to stop the dye feed.

The membrane then closes again and the user can mix the two components by shaking after screwing fitting 8 back onto thread 4 of body 1.

Once mixing has been accomplished, the user inverts the device and expels the mix formed through duct 14 by pressing the wall of body 1.

Although the invention has been described in conjunction with a particular embodiment, it is obvious that it is not limited thereto and a number of changes and variants may be made thereto without thereby departing either from its framework or from its spirit.

What is claimed is:

1. A device for preparing, measuring, and dispensing a cosmetic product obtained by mixing two components immediately prior to use, comprising:

a transparent cylindrical body with a flexible wall, said cylindrical body having two open ends, each said end having identical threads, said flexible wall including at least one series of graduations; and first and second removable end caps, each provided with identical mateable threads on a cylindrical skirt of said cap, said identical mateable threads mating with said threads on each said end of said body, said first end cap having a dispenser, said second end cap having an orifice fitted with an automatically closing non-metallic valve through which one of the components of the cosmetic product can be introduced into said body after the other component has first been introduced into said body through said opposite end, wherein said automatically closing valve has a dome-shaped membrane convex toward an inside of said body when said second cap containing said valve is screwed onto said body, said membrane having at least one slit provided in the vicinity of a top of said dome-shaped membrane and being delimited by edges in contact with each other to produce a sealed closure in a resting state and movable apart allowing passage of a product fed under pressure from a concave outside wall of said dome-shaped membrane and said device further comprises a connecting fitting having a dome-shaped protuberance mateable in shape-matching fashion against said concave outside surface of said dome shaped membrane.

2. The device of claim 1, wherein said threads on said open ends are external threads.

3. The device according to claim 1, wherein two series of graduations are provided on said flexible wall, each of said graduations running in opposite directions along said body.

4. The device according to claim 1, wherein the two components are selected from the group consisting of liquid, cream and gel components.

5. The device according to claim 1, wherein said dome-shaped membrane is attached to said second cap by pressure means ensuring positive closure of said membrane slit.

6. A method for preparing, measuring, and dispensing a cosmetic product obtained by mixing two components immediately prior to use, using a device having a cylindrical body with a flexible wall having two open threaded ends and at least one series of graduations provided on the body, and first and second removable end caps, both end caps being screwable onto either of said fitted open ends of the body, the first end cap having a dispenser while the second end cap includes an orifice fitted with a closing non-metallic valve, comprising the steps of:

installing the second removable end cap onto one of the two threaded ends of the cylindrical body;

introducing a predetermined amount of a first cosmetic product into the cylindrical body through the opposing open threaded end, the predetermined amount being measured visually using the series of graduations;

installing the first end cap having a dispenser onto the remaining open threaded end;

inserting a dispensing fitting of a container containing a second cosmetic product into the non-metallic valve of the second end cap;

and dispensing a predetermined amount of the second component into the cylindrical body, the predetermined amount being visually determined using the at least one series of graduations.

7. The method according to claim 6, wherein the first product is an oxidizer.

8. The method according to claim 6, wherein the second product is a dye.

* * * * *